US011388945B2

(12) United States Patent
Snow et al.

(10) Patent No.: US 11,388,945 B2
(45) Date of Patent: Jul. 19, 2022

(54) HELMET FACE SHIELD

(71) Applicant: The United States of America as represented by the Secretary of the Navy, Arlington, VA (US)

(72) Inventors: Jacob Snow, Bremerton, WA (US); Jacob Yates, Poulsbo, WA (US); Nathan Schuyler, Silverdale, WA (US)

(73) Assignee: The United States of America as represented by the Secretary of the Navy, Keyport, WA (US)

( * ) Notice: Subject to any disclaimer, the term of this patent is extended or adjusted under 35 U.S.C. 154(b) by 70 days.

(21) Appl. No.: 16/974,092

(22) Filed: Sep. 25, 2020

(65) Prior Publication Data

US 2021/0345720 A1 Nov. 11, 2021

Related U.S. Application Data

(60) Provisional application No. 63/101,636, filed on May 6, 2020.

(51) Int. Cl.
*A42B 3/18* (2006.01)

(52) U.S. Cl.
CPC ..... *A42B 3/18* (2013.01)

(58) Field of Classification Search
CPC .. A42B 3/18; A42B 3/225; A42B 3/04; A42B 3/0406; A42B 3/20; A42B 3/22; A42B 1/019; A42B 1/0192; A42B 1/201; A42B 1/205; A42B 1/208
USPC ..... 2/9, 12, 15
See application file for complete search history.

(56) References Cited

U.S. PATENT DOCUMENTS

| | | | | |
|---|---|---|---|---|
| 10,945,470 | B1 * | 3/2021 | Maroofian | A41D 13/1107 |
| 2005/0251890 | A1 * | 11/2005 | Landis | A41D 13/1184 2/9 |
| 2015/0237931 | A1 * | 8/2015 | Miller | A41D 13/1184 2/9 |
| 2021/0298390 | A1 * | 9/2021 | Sup, IV | A41D 13/1184 |
| 2021/0307446 | A1 * | 10/2021 | Baz | A42B 3/20 |
| 2021/0321691 | A1 * | 10/2021 | Sprouse | A41D 13/1184 |

OTHER PUBLICATIONS

United States AirForce Face Shield Image 001.
United States Air Force Face Shield image 002.
SD3D Printing. (2020). SD3D Technical Data Sheet. SD3D Online 3D Print. https://www.sd3d.com/materials, pp. 1.
Rigid.ink Ltd. (2020). PETG Technical Data Sheet. Rigid.Ink. https://www.rigid.ink, pp. 1-3.

* cited by examiner

*Primary Examiner* — Katherine M Moran
(74) *Attorney, Agent, or Firm* — Stephen J. Leahu; Naval Undersea Warfare Center NAVSEA, Keyport Div., U.S. Navy

(57) ABSTRACT

A face shield for use with protective headgear can be shipped flat and easily assembled from a kit of parts without the use of tools or adhesives. The face shield protects against disease, aerosols and splatter that may contain pathogens; may include a curved lower perimeter to facilitate head movements, and can be taken on and off easily.

26 Claims, 6 Drawing Sheets

HELMET FACE SHIELD

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

The present application claims the benefit of U.S. provisional patent application 63/101,636 filed 6 May 2020 and titled: MP Face Shield, the complete disclosure of which is incorporated herein by reference.

The present application is also related to co-pending design patent application Ser. No.: 29/742,344, titled "Helmet Face Shield," filed on Sep. 25, 2020 and incorporated herein by reference.

BACKGROUND OF THE INVENTION

Emergency medical responders, soldiers deployed to field hospitals or disease areas, construction workers, and scientists in laboratories, find wearing certain types of personal protective equipment difficult when they must also wear hard head coverings. In particular, prior art face shields do not fit over hard hats and hard head coverings, such as firefighter headgear, headphones, hearing protection, military helmets and caps without incurring some compromise in fit, area and effectiveness of protection, wearability, or sanitation. These compromises result in compromised performance such as inadequate protection, fogging and obscured vision. Prior art face shields used in conjunction with head protection often choose to protect the eyes and bridge of the nose from impact hazards, while failing to offer full facial protection from airborne aerosols and pathogens.

Prior art face shields also compromise the integrity of the face shield as a disease prevention device when the face shield is integrated into or fixedly attached to the helmet or head protection. Such construction works well so long as the hazard being protected against is not aerosols, disease, or pathogenic particulates/water droplets. These permanently affixed shields are not disposable and must be regularly cleaned or sanitized to prevent contamination and cross contamination. Users are unlikely to regularly perform such a task.

Disposable prior art face shields, such as the type medical professionals wear in a clinical setting, and not integrated into a helmet; are not designed to fit over any sort of hard head covering. To use these existing disposable face shields, the shield must be secured beneath the hard hat. When prior art shields are secured beneath a hard hat, the hard hat does not sit correctly on the head and is unable to properly provide the wearer the intended protection from falling debris. When the hard hat is secured properly, prior art face shields either sit too low and further obscure vision or they sit at such an angle off of the hard hat as to compromise facial protection.

Existing prior art disposable face shields often also include a spongy material designed to press against the forehead. This material exists for the comfort of the user and to distance the face shield forward, away from the face, so that apparatus such as glasses or safety goggles may be worn. However, this spongy material closes off airflow, causing fogging and obscured vision.

Existing prior art disposable face shields also are cut in a rectangular shape of similar length across the lower edge. This feature impedes movement of the head from side to side, and interferes with equipment that may be attached to the shoulder or carried on the shoulder, such as a camera, a rifle, or a set of poles for example. Limiting motion of the head can introduce other hazards for the user who also requires head protection be worn since the user cannot readily turn to see a newly arisen hazard or dangerous situation.

Rapid deployment of face shield PPE requires it be able to ship flat, yet be readily assembled to be used in the field. In dangerous locales, such as field hospitals or natural disaster areas for example, it may also be necessary to don and doff PPE quickly. Existing face shields require specialized adhesives or clasps to assemble, detracting from the ease and speed of assembly and the possibility of missing parts preventing assembly entirely. The configuration of prior art devices also limits the speed with which they can be put on and taken off.

SUMMARY OF THE INVENTION

The present invention includes recognition of the problems and disadvantages of prior art devices.

According to one aspect of the invention, the shape of the disposable and detachable face shield of the invention is such that it may be secured about a hard head covering, such as a hardhat or helmet. Thus, the hard head covering seats correctly atop the wearer while in use and the user enjoys the full benefits of both the face shield protection and the head protection without compromise.

According to another aspect of the invention, slots on either side of the face shield may be used with elastic or flexible materials to further aid in quickly donning or doffing of the invention. This use of elastic or flexible materials allows flexibility in the overall circumference of the shield/helmet interface and allows the invention to be used on a variety of sizes of hard head coverings, while still holding the invention securely in place.

According to yet another aspect of the invention a semi-rigid headband is used between a hard head covering and the invention to provide space between the wearer and the invention, so that apparatuses such as glasses or goggles may be worn, while maintaining sufficient airflow to prevent fogging or obscuring of vision.

According to still another aspect of the invention, the face shield shape is curved around the bottom edge, allowing for full movement of the head from side to side. This aspect allows the wearer to maintain full field of vision while wearing the invention, maintains full coverage of the wearer's face, and prevents the invention from interfering with equipment that may be attached to or rested upon the shoulders, including when the wearer turns their head.

According to a further aspect of the invention, the face shield may be shipped flat and readily assembled in the field without the need for tools, adhesives or clasps.

According to still another aspect of the invention, the invention may be produced using additive manufacturing techniques, such as, for example, 3D printing. This aspect provides additional flexibility in rapidly providing the face shield of the present invention to deployed troops, first responders, and medical personal wherever their location.

Further advantages and features of the present invention will be described in detail below.

BRIEF DESCRIPTION OF THE DRAWINGS

Like reference numerals refer to similar elements or features throughout the drawings.

DESCRIPTION OF EXEMPLARY EMBODIMENTS OF THE INVENTION

The current invention is a face shield that is lightweight, fits over a range of hard head coverings, is easy to don and doff, provides freedom of movement for the head without compromising protection, yet is of minimal complexity with only a few, readily assembled components.

Figure 1:
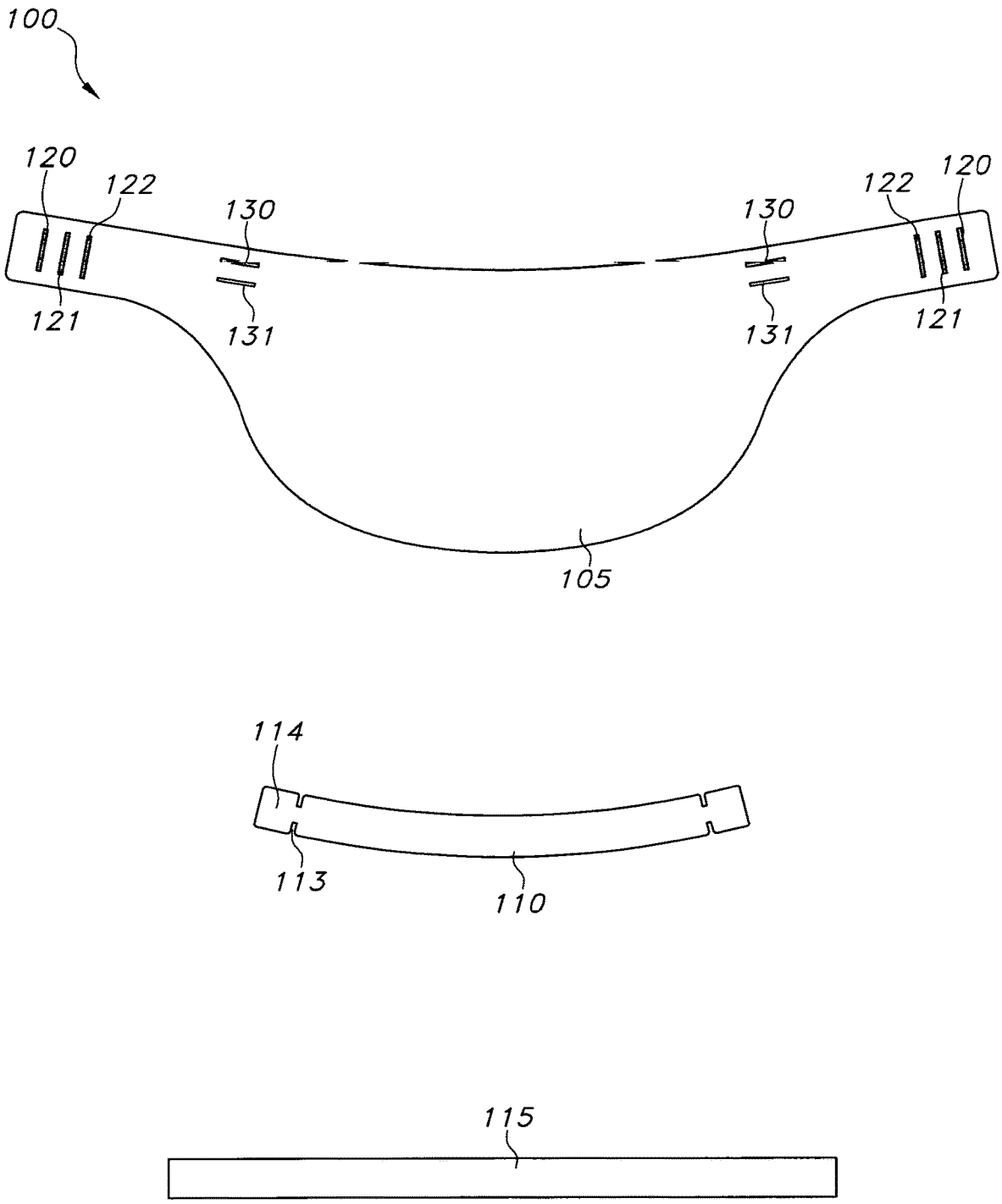
FIG. 1 is a plan view illustration of the unassembled component parts of a face shield according to an embodiment of the invention.
Figure 2:
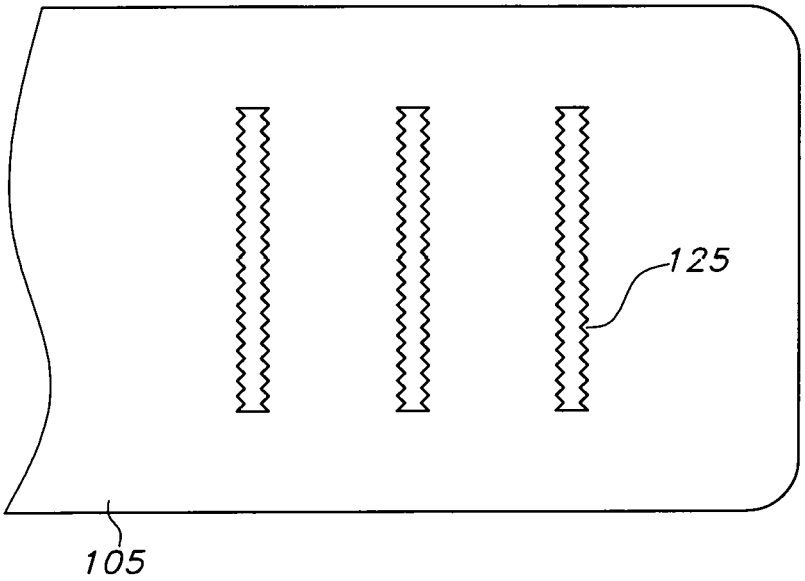
FIG. 2 is a close up view of slot barbs according to an embodiment of the invention.

FIG. 1 shows a plan view of a disassembled MP face shield 100. Face shield 100 comprises of a shield 105, a headband 110, headband notches 113, headband tabs 114, elastic 115, outside elastic hold slot 120, middle elastic hold slot 121, inner elastic hold slot 122, upper headband slot 130, and lower headband slot 131. FIG. 2 is a close up of outer elastic slot 120, middle elastic slot 121, and inner elastic slot 122, showing slot barbs 125. Slot barbs 125 hold elastic 115 in place when elastic 115 is woven through the elastic hold slots. Each of the component elements shown in FIGS. 1 and 2 are substantially flat, thereby making it extremely easy to ship unassembled shields 100 to their ultimate location of use.

Figure 3:
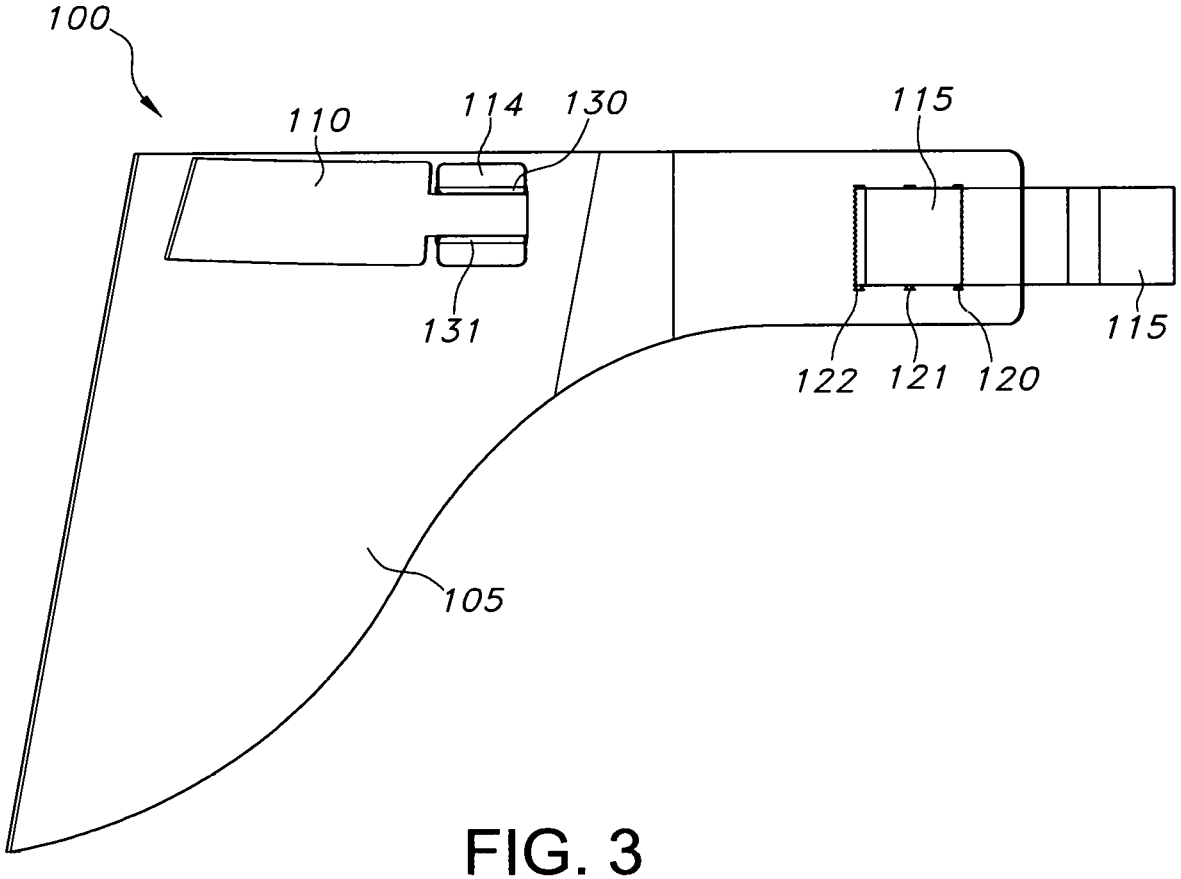
FIG. 3 is a side view of an MP face shield according to an embodiment of the invention.
Figure 4:
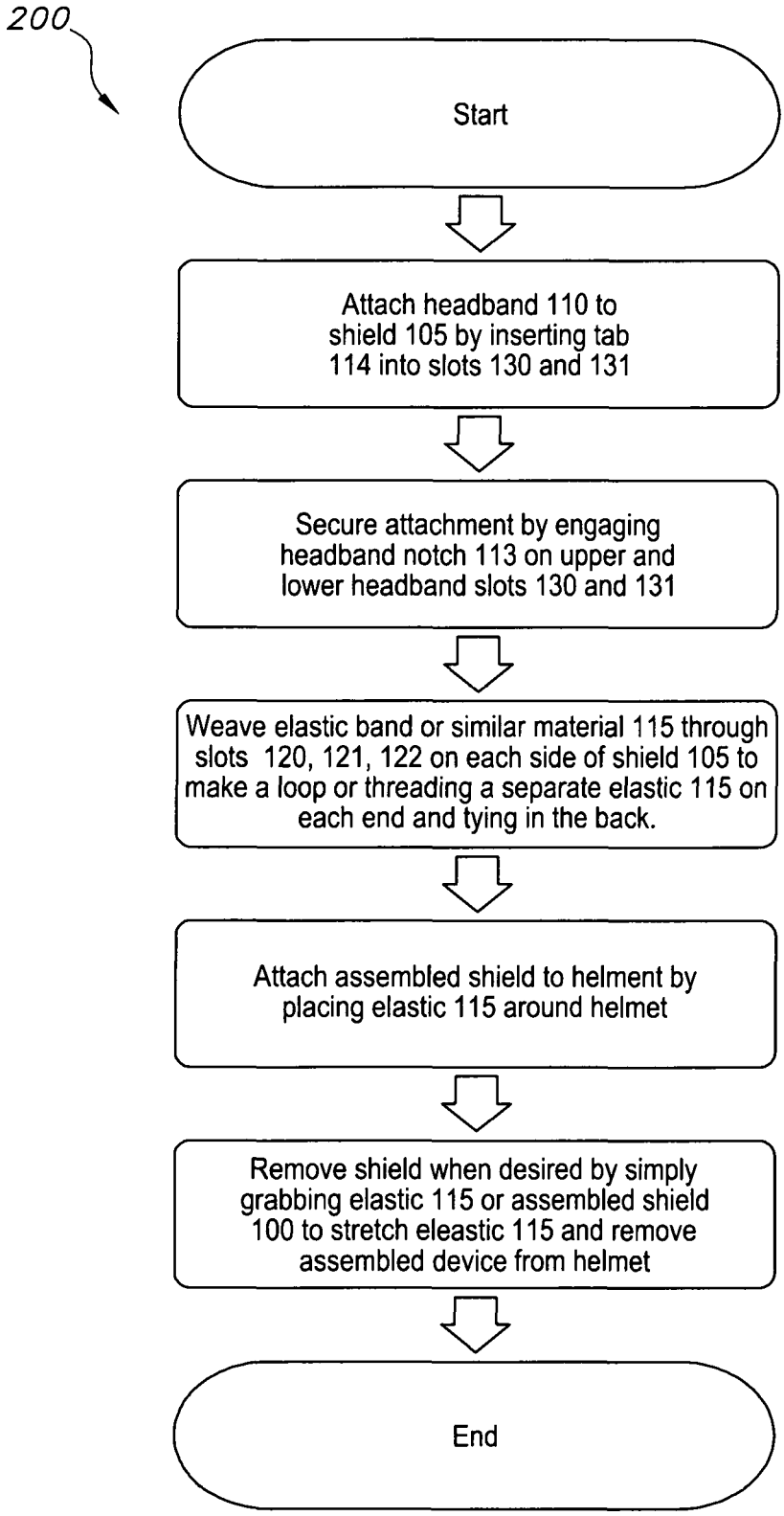
FIG. 4 is a flow chart describing the assembly process for a face shield according to an embodiment of the invention.

FIG. 3 illustrates how MP face shield 100 is assembled and FIG. 4 is a flow chart of the assembly process 200. Headband 110 secures to shield 105 by inserting headband tab 114 into upper headband slot 130 and lower headband slot 131. Headband notch 113 (not visible in FIG. 3 but shown in FIG. 1) catches on upper headband slot 130 and lower headband slot 131, preventing headband 110 from separating from shield 105. Elastic 115 secures MP face shield 100 to the back of a hard hat by weaving through various slots. Elastic 115 is woven up through elastic hold slot 120, down through elastic hold slot 121, up through elastic hold slot 122, and then down through elastic hold slot 120. Friction and slot barbs 125 hold elastic 115 in place.

Figure 5:
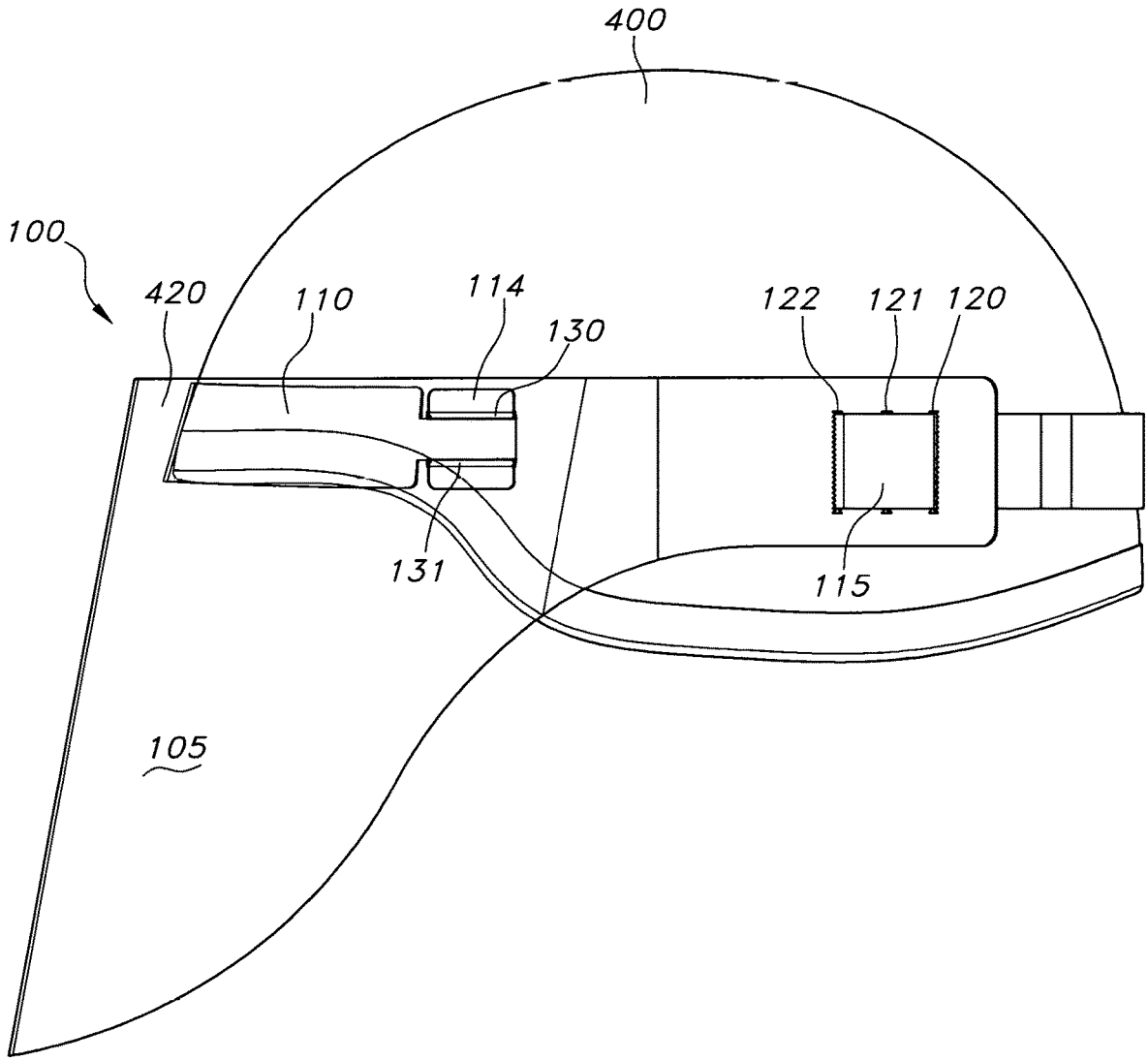
FIG. 5. is a side view of a face shield in use according to an embodiment of the invention.
Figure 6:
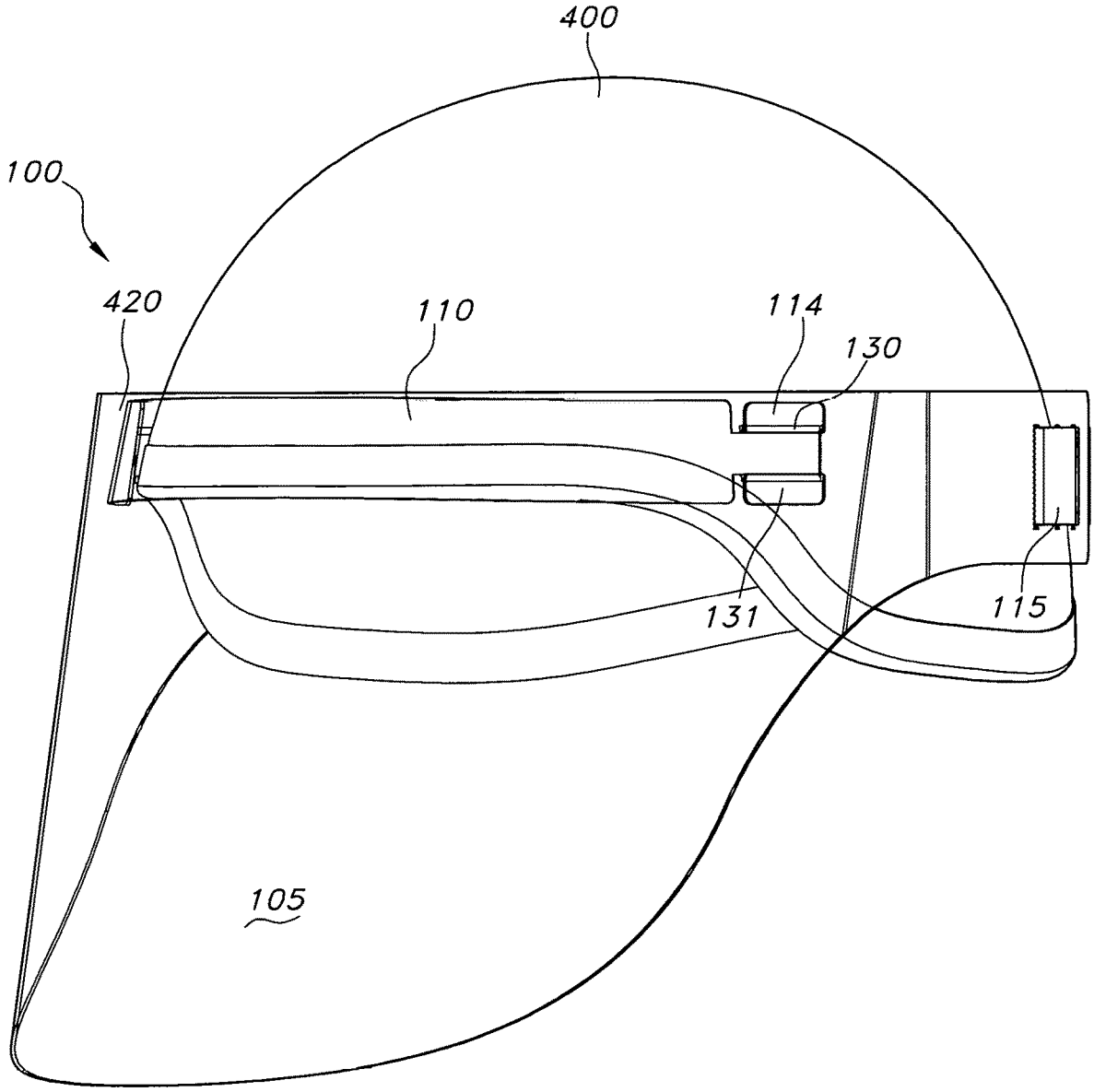
FIG. 6 is a front perspective view of a face shield in use according to an embodiment of the invention.
Figure 7:
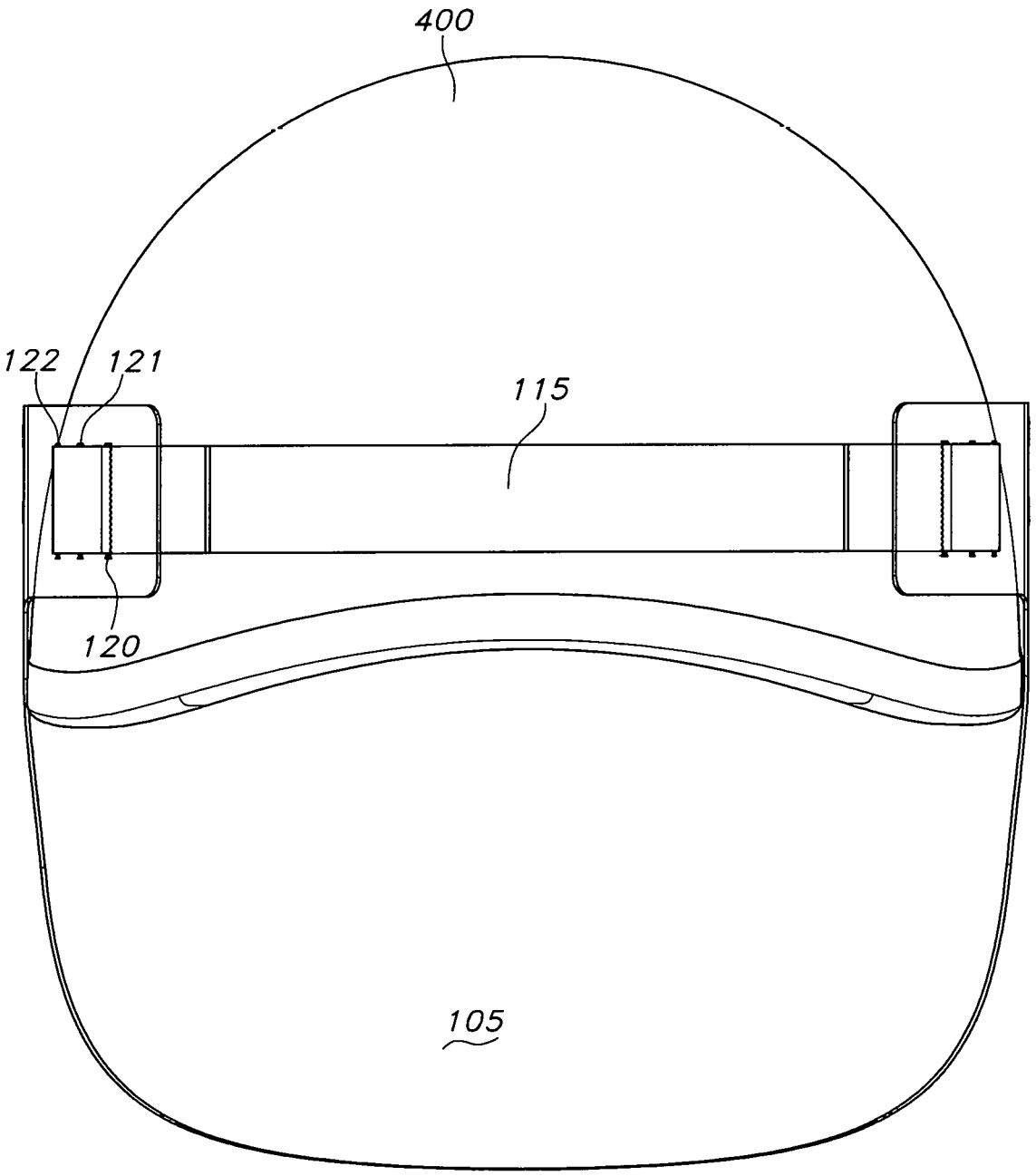
FIG. 7 is a rear view of the invention in use according to an embodiment of the invention.

The assembled face shield 100 is shown in FIGS. 5, 6 and 7. FIG. 5 shows a side view of assembled shield 100 coupled to a helmet 400; FIG. 6 shows a front perspective view, and FIG. 7 shows a rear view. As seen in FIGS. 5-7, elastic 115 wraps around helmet 400. The compression of elastic 115 around helmet 400 provides a secure hold along the back of helmet 400, while still allowing for MP face shield 100 to be quickly put on or taken off while in the field in a similar manner as a ball cap.

FIGS. 5-7 also illustrate various additional features of the present invention that provide advantages not found in the prior art. As shown in FIGS. 5 and 6, the curved lower shape of shield 105 protects the wearer's face while not impeding free movement of the head or interfering with equipment that may be attached or rested on the shoulders. Shield 105 extends past the nose and over the user's mouth down. Shield 105 can continue down near the vicinity of the user's chin. Unlike other helmet-attached face shields, shield 100 extends to protect areas such as the eyes, nose, and mouth where aerosols and airborne pathogens might otherwise be inhaled or splattered upon the user in a manner dangerous to the user's health.

FIGS. 5 and 6 also show headband 110 resting on the exterior of helmet 400. The friction between headband 110 and helmet 400 helps to keep shield 100 in the proper place and orientation. As also seen in FIG. 5, the construction of headband 100 and shield 105 also creates an air gap 420 that enables airflow and prevents fogging of the shield or any glasses or optical gear worn by the user.

FIG. 7 is a rear perspective view illustrating elastic 15 wrapped around the back of helmet 400 and tied off. Assembling an elastic 115 on each end of shield 105 and tying it off in the back is an alternative means of using elastic 115 in lieu of using a single loop of the material threaded into slots 120-122 on each end. This alternative method allows for excess length that may be tied off and to facilitate adjustments Although use of the invention is illustrated with helmet 400, MP face shield 100 is designed for used with a variety of head gear, including but not limited to: hard hats; speed boat, climbing, spelunking, and watercraft helmets; military helmets, firefighting helmets, helicopter helmets, and hearing protection. Face shield 100 thus permits safe operation in situations where it is necessary to both protect the head and protect the face from droplets that may contain pathogens or small flying debris; or to rapidly transit between the locations of such hazards without the need to don and doff different types of gear.

According to one embodiment of the invention, MP face shield 100 is manufactured of a lightweight transparent optically clear plastic, such as polycarbonate, or polyethylene terephthalate glycol (PET-G) the complete technical specification for which is incorporated by reference. These materials can also withstand cleaning if needed. A variety of materials known to those of skill in the art may also be used to construct face shield 100.

Face shield 100 may be produced by additive manufacturing techniques, such as 3D printing; or manufactured using injection molding; or laser-cutting machinery. Three D printing face shield 100 allows the face shield of the present invention to be produced on demand wherever it is needed. MP face shield 100 is also comprised of just a few pieces that assemble with slots and tabs without the use of tools or adhesives or complex instructions. Each of these features of the invention, both separately and collectively, means that the face shield of the present invention is easily deployable and useable in the field including but not limited to, for example; disaster sites, military deployments, remote labs, hazmat construction areas, field hospitals, and disease infested areas.

Elastic 115 may comprise any form of elastic band or compression strap material. Such materials are widely known to those of skill in the art. Elastic 115 may also comprise materials such as shoelaces, para cord, scrunchies, stretch bands or other material that may be threaded through slots 120-122 and tied off with sufficient friction to hold shield 100 in place. The ability to use such materials to secure shield 100 to the user's headgear means that assembly or field repairs—especially in remote locations—are easily made; and shield 100 can continue to be worn without stopping operations to retrieve or print a new device.

The subject matter defined in the appended claims is not necessarily limited to the specific features or acts described above. Rather, the specific features and acts are disclosed as example forms of implementing the claims. Many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A kit for a face shield, comprising:

a transparent face covering of a length sufficient to cover at least a user's eyes and mouth, the transparent face comprising:

a curved perimeter along a bottom edge;

a first plurality of slots located proximate a top edge and a left side outer perimeter;

a second plurality of slots located proximate said top edge and a right side outer perimeter; and, a first and second set of headband slots; and, a headband having a plurality of notches sized to mate with said headband slots.

2. The kit of claim 1, further comprising:

a compression strap sized to fit through said first and said second plurality of slots.

3. The kit of claim 2, wherein said compression strap comprises elastic.

4. The kit of claim 2, wherein said compression strap comprises cord.

5. The kit of claim 2, wherein said compression strap comprises a shoelace.

6. The kit of claim 1, wherein said transparent face covering comprises a transparent plastic.

7. The kit of claim 6, wherein said transparent plastic comprises polycarbonate.

8. The kit of claim 1, wherein said transparent face covering and said headband comprises polyethylene terephthalate glycol.

9. The kit of claim 1, wherein said transparent face covering and said headband are formed by additive manufacturing.

10. The kit of claim 1, wherein said transparent face covering and said headband are formed by injection molding.

11. A method for making a face shield, comprising the steps of:

attaching a headband to a transparent sheet of material, wherein said step of attaching further includes the steps of:

inserting a first headband tab between a first slot and a second slot on said transparent sheet;

inserting a second headband tab between a third slot and a fourth slot on said transparent sheet;

engaging a first headband notch with said first and second slot; and, engaging a second headband notch with said third and fourth slots; and, attaching a compression strap to said transparent sheet of material.

12. The method of claim 11, wherein said step of attaching a compression strap further comprises the steps of:

threading a first end of said compression strap through a first plurality of slots located on said transparent material; and, threading a second end of said compression strap through a second plurality of slots located at a second location on said transparent material.

13. The method of claim 11, wherein said step of attaching a compression strap further comprises the steps of:

threading a first end of a first compression strap through a first plurality of slots located at a first location on said transparent material; and, threading a first end of a second compression strap through a second plurality of slots located at a second location on said transparent material.

14. The method of claim 11, further comprising the step of placing said compression strap around a protective headgear of a user.

15. A face shield comprising:

a transparent face covering of a length sufficient to cover at least a user's eyes and mouth, the transparent face comprising:

a first plurality of compression strap slots located proximate a top edge and a left side outer perimeter;

a second plurality of compression strap slots located proximate said top edge and a right side outer perimeter; and, a first plurality and a second plurality of headband slots;

a headband having:

a first end threaded through said first plurality of headband slots;

a second end threaded through said second plurality of headband slots;

a first notch located proximate said first end and connected to at least one of said first headband slots; and, a second notch located proximate said second end and connected to at least one of said second headband slots; and, a compression strap having threaded through said first and second plurality of compression strap slots.

16. The face shield of claim 15, wherein said transparent face covering further comprises a curved bottom perimeter.

17. The face shield of claim 15, wherein said compression strap comprises elastic.

18. The face shield of claim 15, wherein said compression strap comprises cord.

19. The face shield of claim 15, wherein said compression strap comprises a shoelace.

20. The face shield of claim 15, wherein said transparent face covering comprises a transparent plastic.

21. The face shield of claim 20, wherein said transparent plastic comprises polycarbonate.

22. The face shield of claim 15, wherein said transparent face covering and said headband comprises polyethylene terephthalate glycol.

23. The face shield of claim 15, wherein said transparent face covering and said headband are formed by additive manufacturing.

24. The face shield of claim 15, wherein said transparent face covering and said headband are formed by injection molding.

25. The face shield of claim 15, wherein said transparent face covering and said headband are formed by laser cutting.

26. The kit of claim 1, wherein said transparent face covering and said headband are formed by laser cutting.

* * * * *